US005312711A

United States Patent [19]

Tavernier et al.

[11] Patent Number: 5,312,711

[45] Date of Patent: May 17, 1994

[54] DRY ELECTROSTATOGRAPHIC DEVELOPER COMPOSITION

[75] Inventors: Serge M. Tavernier, Lint; Paul F. Sterckx, Begijnendijk; Jean-Marie O. Dewanckele, Drongen, all of Belgium

[73] Assignee: AGFA-Gevaert, N.V., Mortsel, Belgium

[21] Appl. No.: 730,480

[22] Filed: Jul. 16, 1991

[30] Foreign Application Priority Data

Jul. 19, 1990 [EP] European Pat. Off. ..... 90113845.3

[51] Int. Cl.[5] ..... G03G 9/00; G03G 5/00; G03G 9/083; G03G 9/107

[52] U.S. Cl. ..... 430/110; 430/106.6; 430/109; 430/111; 430/137

[58] Field of Search ..... 430/110, 109, 137, 106.6

[56] References Cited

U.S. PATENT DOCUMENTS 4,748,474 5/1988 Kurematsu et al. ..... 430/111

4,973,540 11/1990 Machida et al. ..... 430/110

FOREIGN PATENT DOCUMENTS 60-093455 5/1985 Japan ..... G03G 9/08

*Primary Examiner*—Marion E. McCamish
*Assistant Examiner*—Stephen C. Crossan
*Attorney, Agent, or Firm*—Breiner & Breiner

[57] ABSTRACT

A negatively-chargeable dry electrostatographic developer is disclosed containing fluorinated inorganic microparticles, and toner particles comprising an acidic binder resin having an acid value between 10 and 30 mg KOH/G and not comprising (a) charge-controlling agent(s). The developers according to this invention show excellent fluidity and have improved negative chargeability. According to a preferred mode, fluorinated silica-type microparticles are added to the developer as free flowing additive in an amount of 0.1 to 5% by weight with respect to the toner, which preferably comprises an acidic carbon black.

14 Claims, No Drawings

DRY ELECTROSTATOGRAPHIC DEVELOPER COMPOSITION

FIELD OF THE INVENTION

The present invention relates to electrophotography and more in particular to a developer composition for use in electrostatographic applications, whereby apart from the particular toner/carrier mixture, specially designed additives are used.

BACKGROUND PRIOR ART

It is well known in the art of electrographic and electrophotographic copying and printing to form an electrostatic latent image corresponding to either the original to be copied, or corresponding to the digitized data describing an electronically available image, on a photoconductive member. In another image forming method, the electrostatic latent image is formed by imagewise discharge over styli towards a dielectric substratum. The xeroprinting process such as disclosed e.g. in European Patent Application 0 243 934 involves imagewise exposing a photopolymer master, charging e.g. by corona, toning with dry or liquid toner and transferring to another substrate.

Electrostatic latent images can be developed using a liquid developer consisting of a colloidal system of charged colloidal particles in an insulating liquid. In most cases the latent image is developed with a finely divided developing material or toner to form a powder image which is then transferred onto a support sheet such as paper. The support sheet bearing the toner powder image is subsequently passed through a fusing apparatus and is thereafter discharged out of the copying resp. printing machine as a final copy, resp. final print.

One of the objectives set forth for the overall electrostatographic process is to provide an image on the final copy, resp. final print with the best possible quality.

By 'quality' in electrostatography is generally understood a true, faithful reproduction of the original to be copied, or faithful visual print of the electronically available image.

Quality consequently comprises features such as uniform darkness of the image areas, background quality, clear delineation of lines, as well as overall resolution of the image.

The accuracy, inclusive of the resolution, by which the latent electrostatographic image, formed in either an electronic printing or copying apparatus, is developed into a visually discernable copy, is predominantly determined by the characteristics of the developer used.

It is known that one of the principal contributing characteristics herefore is the size and size distribution of the developer particles used, and in case a two component developer material is used, in particular the size and size distribution of the toner particles employed.

In the document published by ATR Corporation, 6256 Pleasant Valley Road, El Dorado, Calif. 95623, entitled 'Effect of Toner Shape on Image Quality' published Mar. 28, 1988, the influence of toner particle diameter and shape upon image quality, particularly for high resolution images, has been tested.

For a developer to be used in a high resolution laser beam printer, the effects of toner particle size and shape upon the image were experimentally examined. As a result it was made clear that apart from the shape of the toner and its charge distribution, fine particles are most effective to provide high resolution.

This fact being known in itself, there have been several prior art proposals for the manufacture of fine toner particles and in particular for toner particles, the size distribution of which meets a well-defined classification.

In U.S. Pat. Nos. 3,942,979 and 4,284,701 the preparation and use of toner particles with well-defined particle-distributions has been disclosed.

Apart from the size distribution, the resolution of an electrostatographic print is determined also to a large extent by the average or median size of the toner particles. So efforts have been made to manufacture and use extremely fine developer materials.

However the smaller the average size of the toner particles, the greater the tendency of the toner and of the overall developer composition to agglomerate or to cluster together, and the greater the tendency of the toner particles to stick to the image bearing member. In order to partially remedy these problems it is known to add a lubricant, e.g. zinc stearate, in an amount of at least 0.5 wt %, to the developer composition, as is disclosed e.g. in UK application GB 2,180,948.

In JP KOKAI 60-159857 a magnetic toner superior in fluidity and tranferability is disclosed, said toner comprising a thermoplastic resin such as polyethylene wax, a colorant, a magnetic material, a silica and a surfactant having perfluoroalkyl groups.

In JP KOKAI 63-300243 a low-temperature fixable toner is disclosed wherein in order to prevent blocking the surface of each specified particle is coated with a specified F-containing silane compound.

EP-A-0 050 987 discloses a one-part flowable, dry, electrostatically attractable toner comprising a thermoplastic binder and a magnetically responsive material and a surface treatment composition comprising a fluoroaliphatic compound.

Also in JP KOKAI Nr. 60-93455 the addition of a fluorine substituted silane coupling agent to toner is disclosed, said agent being e.g. colloidal silicon dioxide. In said specification the effects of enhanced flowability and negative chargeability of the developer wherein such fluorinated particles are incorporated, are set forth and in particular the decreased dependence on environmental conditions is put forward. In the examples of said specification, a styrene-acrylic and a polyester resin is used as binder for the developer, whereas the particle size of the developer is set to be around 10 micron.

In EP-A-0 335 676 a developer for developing electrostatic images is disclosed, said developer comprising 0.05 to 3 wt parts of hydrophobic silica fine power having a tribo electric chargeability of −100 to −300 μc/g. According to a preferred mode described in said specification the silica fine power is produced through vapor phase oxidation of a silicon halide, treated with a silane coupling agent and/or silicone oil. As preferred examples of such silicone oil are mentioned i.a. a fluorinemodified silicone oil.

It is quite common in the art of manufacturing electrostatographic developers to incorporate charge controlling agents (commonly called CCA's) into the developer mass. In the latter EP specification, it is set forth that the toner according to the invention disclosed therein may also contain as desired such CCA-compound, and in all (eight) examples described in said specification a negative charge control agent (a particular Cr-complex) is indeed incorporated in the developer.

A difficulty arising in the manufacture of fine toner particles is the requirement of intimate and uniform incorporation of the ingredients in the toner particles. Variations in the composition of the individual toner particles should be avoided. This applies in particular to the incorporation of CCA-compounds in the toner particles. Indeed, variations in the amount of CCA's incorporated in the toner particles give rise to varying charges carried by the toner particles which in turn cause several problems in processing e.g. a selectivity in development so that the composition of the developer in multi-use changes as a function of print amount, further a shift in average charge-mass relationship (Q/m) value altering the copy quality by variations in copy density, resolution etc. Concomitantly a detrimental effect on the transfer efficiency is observed. Such non-uniform distribution of the CCA's over fine toner particles in particular occurs when using large CCA-compounds, such as disclosed e.g. in U.S. Pat. No. 4,525,445. When using soluble CCA-compounds the uniformity of the distribution of the CCA-compounds over the toner can be increased, however such soluble CCA have a plasticizing effect on the toner particles, causing other problems such as a reduction of the lifetime of the toner particles by smearing on the carrier surface. This phenomenon impedes the use of tougher (higher Tg) polymers, indirectly affecting fusing characteristics in an adverse way. This causes difficulties in particular when toners/developers are considered for use in full-color applications. Finally one could use CCA-compounds built-in in the toner-binder resin. These CCA-compounds have the disadvantage however of a high price and complexity in preparation. As a conclusion it may be set forth that the problem-free incorporation of CCA-compounds in toner particles featuring a well-defined size distribution as characterized by e.g. a fine average particle size is not yet satisfactorily solved.

OBJECT OF THE INVENTION

It is therefore an object of the present invention to provide dry developer materials that exhibit superior performance over the prior art dry developer materials in terms of overall performance of the electrostatographic process.

In particular it is one of the objects of the present invention to provide fine dry developer materials that exhibit excellent fluidity and uniform chargeability and whereby the problems resulting from a non-uniform distribution of charge controlling agent over the fine dry toner particles does not arise.

More in particular, it is one of the objects of the present invention to provide fine dry developer materials to be negatively charged and which exhibit excellent fluidity and charge control.

SUMMARY OF THE INVENTION

We have now found that the above objects are accomplished by providing a dry electrostatographic developer suitable for use in the development of an electrostatic charge pattern, comprising inorganic microparticles containing fluor containing groups in an amount sufficient to enhance the flowability and negative chargeability of the developer particles and negatively chargeable toner particles comprising an acidic binder resin having an acid value between 10 and 30 mg KOH/G and not comprising (a) charge controlling agent(s).

According to a preferred embodiment of our invention the inorganic microparticles are fluorinated silica-type microparticles are surfacemodified fumed silica, treated with a silane compound comprising at least one fluorine atom; more specifically the silane compound corresponds to the general formula $$(R^1)_{3-n}\overset{R_f}{\overset{|}{Si}}(OR^2)_n$$

wherein $R^1$ is an alkyl group, preferably a $C_1$–$C_4$ alkyl group, $R^2$ is a $C_1$–$C_4$ alkyl group e.g. methyl, ethyl, n is 1, 2 or 3, preferably 3, and Rf is a fluoroalkyl, fluoroalkoxy or fluoroalkoxyalkyl group comprising at least one fluorine comprising carrier particles apart from the negatively chargeable toner particles.

Preferably said fluorinated fumed silica is added as a free flowing powder to the developer which preferably is a two-component developer composition.

Preferred embodiments of the present invention are described in the detailed description set forth hereinafter.

DETAILED DESCRIPTION OF THE INVENTION

In the Article entitled 'Aerosil-Grundlagen und Anwendungen', published in Chemie für Labor und Betrieb, 32. Jahrgang, Number 7/1981, pages "303–305, the nature and use of various kinds of Aerosils are disclosed. In this article also the function of the silanol groups, present on the surface of fumed silica, is described. In the European Patent Application 0 293 009 (Toray Silicone Co.) there is disclosed that the fluidity of a toner resin powder is substantially increased when such powder is combined with a hydrophobic silica-type micropowder comprising silica-type microparticles which have been treated with certain secondary or tertiary amine-functional silanes. According to said patent specification, the amine-functional silanes, containing alkoxy groups, become bonded to the silica-type microparticles via a condensation reaction between the alkoxy-group of the amine-functional silane and the silanol groups on the surface of the silica-type microparticles.

In accordance with the present invention fluor-containing silica-type microparticles can be prepared by a reaction between the silanol-groups of the silica-type microparticles and fluor-containing silanes similar to the reaction mechanism described in the cited European specification. More details about the preparation of the fluorinated aerosils for use according to the present invention are set forth in the European patent application of Degussa AG, 6000 Frankfurt am Main, Germany, filed on 19.07.'90, entitled 'Oberflächenmodifizierte Siliciumdioxide'. In said specification of Degussa AG, the preparation of four particular fluorinated aerosils has been described using the following particular silane-compounds:

$$CHF_2—CF_2—O—(CH_2)_3—Si—(OCH_3)_3$$

$$CHF_3—CHF—CF_2—O—(CH_2)_3—Si—(OCH_3)_3$$

$C_4F_9—CH_2—CH_2—Si—(OCH_3)_3$ $C_6F_{13}—CH_2—CH_2—Si—(OCH_3)_3$

Silica-type microparticles useful for the preparation of the fluorinated microparticles of the present invention are also described in this specification and include fumed silica, silica aerogel, precipitated silica, and the composite microparticles (silica +another metal oxide) prepared from silicon tetrachloride and another metal halide such as aluminium trichloride, titanium tetrachloride and the like. Fumed silica is however most preferred for the application of the present invention.

Apart from the fluorinated silica type microparticles described hereinbefore, other fluorinated types of microparticles may be used for the application of the present invention, e.g. the aluminium-, titanium-, zirconium-oxides and other types of oxides such as disclosed in Table 2 of the articles of G.W. Kriechbaum and P.Kleinschmit entitled 'Superfine oxide Powders-Flame Hydrolysis and Hydrothermal Synthesis, as published in' Angew. Chem. Adv. Mat. 101, 1989, No. 10, pages 1446–1453.

The specific surface area BET-value as determined according to the method described by S. Brunauer, P. H. Emmett and E. Teller, (19–30) J. Amer. Chem. Soc. 60, 309–312 of the inorganic microparticles described above should preferably be at least 100 m2/g.

Due to the treatment of the silica-type microparticles with the fluor-containing silane-groups, the resulting fluorinated microparticles when contacted and agitated with a magnetic powder such as iron powder or iron oxide powder, will become negatively charged.

This aspect makes these microparticles particularly suited not only as fluidity improver but also as charge generator for negatively chargeable toner particles.

The amount of fluorinated microparticles by weight with respect to the toner particles should preferably be between 0,1 and 5%, more preferably between 1 and 3%.

The fluorinated microparticles according to the present invention may either be added as a free-flowing powder to the developer particles, either be attached to the surface of the developer particles by mechano fusion as described in the journal entitled, Powder Technology, 59 (1989). 45–52 "Mechanism of the combined coating, Mechanofusion, Processing of Powders" (M. Alonso, M. Satoh, K. Miyanamif), or be incorporated in the matrix of the toner particles by melt homogenisation and subsequent milling.

The toner particles used in combination with the fluorinated microparticles of the present invention preferably should comprise common ingredients such as resins or pigments modifying the melt viscosity, release-promoting compounds, toner-offsetting preventing compounds, and colouring substances. More details about toner compositions for use in accordance with the present invention can be found in European Patent Application EP 89 201 695.7.

Particulars of the overall electrostatographic process wherein the developers comprising the fluorinated microparticles according to the present invention can be used, are disclosed in the latter specification.

In order to acquire a sufficient negative chargeability, the developer of our invention must comprise as binder resin a polymer of sufficient acidity. Only then the combination of such acidic binder resin with the fluorinated microparticles yield a sufficient negative chargeability so that the incorporation of (a) CCA-compound(s) in the developer of our invention becomes redundant.

Therefore the acidity of the selected binder resin must be such that the acid value of said resin is at least 10 and preferably not higher than 30 mg KOH/G. Binders featuring an acid value below 10 are not suitable for yielding developer materials with sufficient negative chargeability without incorporation of CCA-compounds. Toners made up on the basis of such binders necessarily comprise additional CCA-compounds so as to acquire sufficient negative chargeability.

On the other hand binder resins with acid values above 30 mg KOH/G have an enhanced tendency of moisture absorption making such resins inapt for use as binder in fine toner particles.

Examples of acidic binder resins suitable for use according to the present invention are : addition or condensation polymers having a sufficiently high number of groups of acidic nature such as carboxylic acid groups, sulphonic acid groups and phenol-type hydroxy groups so as to obtain an acid value above 10 mg KOH/G. More particularly are mentioned vinyl type addition polymers possessing in their structure said acidic groups introduced by (random) copolymerization or graft-copolymerization, e.g. copolymers of lower alkyl esters of acrylic acid and/or styrene with unsaturated acids such as acrylic acid, methacrylic acid, maleic acid and itaconic acid or copolymers of butadiene wherein the mentioned groups of acidic nature have been introduced by graft-copolymerization.

Preferred acidic condensation polymers for use according to the present invention are acidic polyester resins, e.g. those produced by the condensation reaction of a polyol or mixture of polyols, e.g. ethylene glycol, triethylene glycol and an alkoxylated bisphenol, especially bisphenol A, i.e. [2.2-bis(4-hydroxyphenyl)-propane], with a dicarboxylic acid or mixture of dicarboxylic acids, e.g. maleic acid, fumaric acid, itaconic acid, malonic acid, isophthalic acid and optionally partly with a polyacid having at least 3 carboxylic acid groups such as trimellitic acid yielding some crosslinking.

The preparation of linear polyester resins of the above type is described in GB-P 1,373,220.

A particularly useful acidic polyester binder is derived from fumaric or terephthalic acid that is polycondensed with less than 1 equivalent of an ethoxylated and/or propoxylated "bisphenol A".

The synthesis of partly crosslinked polyesters for use in accordance with the present invention is described e.g. in published GB-2082788A patent application disclosing toner comprising as a binder a polyester resin obtained from a diol or mixture of diols represented by the following general formula;

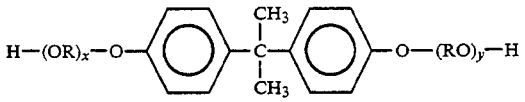

wherein R represents an ethylene or propylene group, x and y are independent numbers such that the average value of their sum is 2 to 7; and a polycarboxylic acid or a derivative thereof, which is a mixture of a dicarboxylic acid or a $C_{1-6}$ alkyl ester thereof and a tri- or polycarboxylic acid or an acid anhydride thereof, the content of said tri- or polycarboxylic acid or acid anhydride being from 30 to 80 mol % of the acids.

The coloring substance(s) used in the toner particles of the present invention may be any inorganic pigment (including carbon) or solid organic pigment or dye, or mixtures thereof commonly employed in dry electrostatic toner compositions, soluble or dispersable in the polymeric binder of said toner compositions.

In order to obtain toner particles with sufficient optical density in the spectral absorption region of the colorant, the colorant is used preferably in an amount of at least 2% by weight with respect to the total toner composition, more preferably in an amount of 5 to 15% by weight.

For black toners preference is given to carbon black as a colorant.

Examples of carbon black and analogous forms therefore are lamp black, channel black, and furnace black. According to a preferred mode of our invention an acidic colorant, such as e.g. an acidic carbon black should be incorporated in the toners as such acidic compound further enhances the negative chargeability of the developer of our invention. As a consequence the difficulties resulting from the incorporation of CCA-compounds in the toner of our invention are avoided because there is no need to incorporate any CCA-compound in the developer of our invention. Examples of such preferred acidic carbon black are SPEZIALSCHWARZ IV (trade-name of Degussa Frankfurt/M, W.Germany) and VULCAN XC 72 and CABOT REGAL 400 (trade-names of Cabot Corp. High Street 125, Boston, U.S.A.). The characteristics of these preferred acidic carbon blacks are listed in the following Table 1.

TABLE 1

| | SPEZIALSCHWARZ | CABOT REGAL 400 |
|---|---|---|
| origin | channel black | furnace black |
| density | 1.8 g × $cm^{-3}$ | 1.8 g × $cm^{-3}$ |
| grain size before entering the toner | 25 nm | 25 nm |
| oil number (g of linseed oil adsorbed by 100 g of pigment) | 300 | 70 |
| specific surface (sq.m per g) | 120 | 96 |
| volatile material (% by weight) | 12 | 2.5 |
| pH | 3 | 4.5 |
| colour | brown-black | black |

Toners for the production of colour images may contain organic dyes or pigments of the group of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York (1950).

Typical inorganic pigments include black iron(III) oxide, copper(II) oxide and chromium(III) oxide powder, milori blue, ultramarine cobalt blue and barium permanganate.

In order to obtain toner particles having magnetic properties a magnetic or magnetizable material may be added during the toner production.

As is set forth above, so as to obtain high-quality electrostatic images, fine developer materials should be employed in the electrostatographic process. Therefore the developer compositions suitable for use in accordance with the present invention may be prepared by appropriately selecting and modifying some of the known toner mixing and comminution techniques. As is generally known toner is prepared by subsequently blending and mixing the components in the molten state and after cooling, milling and micropulverizing the resulting mixture. Thereafter so as to obtain toner particles corresponding to predetermined particle-sizes, a suitable particle classification method is employed. Typical particle classification methods include air classification, screening, cyclone separation, elutriation, centrifugation and combinations thereof.

The preferred method of obtaining the very fine toner particles of our invention is by centrifugal air classification.

Suitable milling and air classification results may be obtained when employing a combination apparatus such as the A.F.G. (Alpine Fliessbeth-Gegenstrahlmühle) type 100 as milling means, equipped with an A.T.P. (Alpine Turboplex windsichter) type 50 G.S., as air classification means, the model being available from Alpine Process Technology Ltd., Rivington Road, Whitehouse, Industrial Estate, Runcorn, Cheshire, U.K. Further air classification can be realised using an A 100 MZR (Alpine Multiplex Labor Zick-zack sichter) as additional classification apparatus, the latter model being also available from Alpine Process Technology Ltd. The size distribution of the so obtained toner particles can be determined in a conventional manner by employing a Coulter Counter type TA II/P-CA1, model available from the Coulter Electronics Corp., Northwell Drive, Luton, Bedfordshire, LV 33 R4, United Kingdom.

In the air classification apparatus, air or some other gas is used as transport medium and particles contained in the fluidum are exposed to two antagonistic forces, viz., to the inwardly directed tractive force of the fluidum, and to the outwardly directed centrifugal force of the particle. For a definite size of particles, that is, the "cut size", both forces are in equilibrium. Larger (heavier) particles are dominated by the mass-dependent centrifugal force and the smaller (lighter) particles by the frictional force proportional to the particle diameter. Consequently, the larger or heavier particles fly outwards as coarse fraction, while the smaller or lighter ones are carried inwards by the air as fine fraction. The "cut size" usually depends upon the geometrical as well as operational parameters (dimensions of classification, rotor, rotational velocity, etc.). Adjustment of the cut size may be effected through variation of the above mentioned parameters.

When developer materials are manufactured according to the abovementioned procedures, the operating parameters should be set such that, according to a preferred made of operation of the present invention, developer materials are obtained characterized in that more than 90% of the toner particles have an equivalent particle size diameter comprised between 1 and 7 micron, more preferably between 3 and 6 micron.

Full particulars about toner particles the size-distribution whereof corresponds a well defined parameters, such that the obtained developer is suitable for use in the production of high quality electrostatographic imager, are disclosed in EP-A-8920/695.7

The following examples illustrate the invention without, however, limiting it thereto. All parts, ratios and percentages are by weight.

EXAMPLES 1-5

Toner Preparation 90 parts of ATLAC T500 (trade name of Atlas Chemical Industries Inc., Wilmington, Del., USA) being a propoxylated bisphenol A fumarate polyester with a glass transition temperature of 51° C., a melting point in the range of 65° to 850° C., an acid number of 13.9, and an intrinsic viscosity measured at 250C in a mixture of phenol/ortho dichlorobenzene (60/40 by weight) of 0.175, 10 parts of Cabot Regal 400 (trade name of Cabot Corp., Boston, Mass., USA) being a carbon black, were introduced in a kneader and heated at 120° C. to form a melt, upon which the kneading process was started. After about 30 minutes, the kneading was stopped and the mixture was allowed to cool to room temperature (20° C). At that temperature the mixture was crushed and milled to form a powder, which was further reduced in grain size by jet milling. Further, air classification using a combination apparatus such as the A.F.G. (Alpine Fliessbeth-Gegenstrahlmühle) type 100 as milling means, equipped with an A.T.P. (Alpine Turboplex windsichter) type 50 G.S., as air classification means, the model being available from Alpine Process Technology Ltd., Rivington Road, Whitehouse, Industrial Estate, Runcorn, Cheshire, U.K. Further air classification was realised using an A 100 MZR (Alpine Multiplex Labor Zick-zack sichter) as additional classification apparatus, the latter model being also available from Alpine Process Technology Ltd. The size distribution of the so obtained toner particles was determined in a conventional manner by employing a Coulter Counter type TA II/PACAI, model available from the Coulter Electronics Corp., Northwell Drive, Luton, Bedfordshire, LV 33 R4, United Kingdom.

The average equivalent particle size diameter by volume measured in the aforementioned Coulter Counter apparatus was 5 micron, and more than 90% of the particles had an equivalent particle size diameter between 3 and 6 micron.

Addition of Microparticles

The toner particles, the preparation of which is described hereinabove, were introduced in a mixing apparatus according to the procedure as described hereinafter and the inorganic microparticles were admixed to the toner particles.

The microparticles were modified fumed silica as prepared by flame hydrolysis and with specific BET-surfaces ranging from 100 to 300 m2/g. The fumed silica had been modified with the following compounds:

| Example no. | Group | BET value (m2/g) |
|---|---|---|
| ex 1 (comparative) | -aminopropyl-Silane | 150 |
| ex 2 (comparative) | dichlorodimethylsilane | 110 |
| ex 3 (comparative) | hexamethyldisilazane | 200 |
| ex 4 (comparative) | -(untreated aerosil) | 200 |
| ex 5 (acc. to inv.) | $C_4F_9(CH_2)_2Si(OCH_3)_3$ | 180 |

The modified fumed silicas according to example 1, 2 and 3 are marketed by Degussa under the trade names R504, R972, and R812 resp.

The method of adding the modified Aerosils to the toner particles was as follows : 100 g of toner and 1,5 g of Aerosil were fed to a Janke and Kunkel labor-mill apparatus type IKA M20, rotating at a speed of 20,000 rpm, and thermostabilised at 20° C. (model available from the Janke and Kundel GmbH, IKA Labortechnik, D-7813 Staufen, W.Germany). Mixing time 15 sec.

In most of the examples, the addition of the Aerosil to the toner particles caused a clearly noticeable improvement of the flow properties of the toner particles.

| example | relative flow rate |
|---|---|
| toner without additive | 1 (reference) |
| ex. 1 | 1.4 |
| ex. 2 | 1.5 |
| ex. 3 | 4 |
| ex. 4 | 0.6 |
| ex. 5 | 2.2 |

The relative flow rate measurements as set forth hereinabove indicate the amount of toner-additive mixture by weight that during a predetermined time period passes through a calibrated opening.

Developer Composition

Hereupon a developer composition for use in a two-component electrostatographic process was prepared as follows : after addition of the toner/additive mixture according to the examples set forth above to an ordinary Zn-Ni-ferrite carrier (approximately 100 um large) in an amount of 5% by weight with respect to the carrier, the developer was activated by rolling in a metal box with a diameter of 6 cm, at 300 revolutions per minute, during a period of 30 minutes, with an apparant degree of filling of 30%.

Evaluation

The developer compositions prepared according to the above cited manner were further evaluated. The tribo-electric charge of the toner was expected to be negative from its constitution, as it comprises a negative orienting resin (polyester) and an acidic carbon black. Tribo-electric values were determined by conventional blow-off methods and results are expressed as a charge pro mass ratio : Q/m. The detailed description of the method is set forth in European patent application no. 89200766.7.

The experimental results of the measurements of the tribo-electric charges of the developers prepared as set forth hereinabove are as follows:

| example no. | Tribo-electric charge |
|---|---|
| ex 1 | 1 uC/g |
| ex 2 | 14 uC/g |
| ex 3 | 13 uC/g |
| ex 4 | 8 uC/g |
| ex 5 | 18 uC/g |

As a conclusion it may be set forth that only the developer of example no. 5 yield high quality when used in an electrophotographic apparatus.

EXAMPLES 6-7

A colourless toner was prepared in a similar way as described in the 'toner preparation' of examples 1-5, except that no carbon black was used.

The inorganic microparticles of the above examples 3 and 5 were added in an amount of 2.5 g to 100 g of colourless toner. Developers were prepared by addition of the toner-additive mixtures to the carrier as described in ex 1-5 in an amount of 4% by weight. No useful developer could be obtained using the additive of comparative example no. 3 as the charge to mass ratio was too low and a dusty mixture showing demixing resulted.

However, the developer comprising toner whereby the $C_4F_9(CH_2)_2$-group containing silica was used gave a tribo-electric value of −17 uC/g, and showed good results when used in an electrostatographic process.

EXAMPLE 8

A developer was prepared as described in the example 5 with the following difference however instead of ATLAC T500. 90 parts of a bisphenol-A-type-polyester with a glass transition temperature of 57° C. a melting point in the range of 75° C.-95° C. and an acid number of 6 was used.

To the so prepared toner were added the fluorinated microparticles of example 5, resulting in a relative flow rate of 3.8.

The resulting developer showed however a tribo-electric charge amounting to only −11 μC/g. So this developer had not a high enough negative chargeability resulting i.a. in some wrong sign toner particles resulting in fog when used in a electrophotographic apparatus.

We claim:

1. Dry electrostatographic developer suitable for use in the development of an electrostatic charge pattern, comprising inorganic microparticles containing fluor containing groups in an amount sufficient to enhance the flowability and negative chargeability of the developer particles and negatively chargeable toner particles comprising an acidic binder resin having an acid value between 10 and 30 mg KOH/g and not comprising (a) charge controlling agent(s) and featuring a classified size distribution wherein more than 90 percent by volume of the toner particles have equivalent particle size diameters between 1 and 7 micron.

2. Dry electrostatographic developer according to claim 1 wherein the toner particles comprise an acidic carbon black.

3. Dry electrostatographic developer according to claim 1 wherein said inorganic microparticles are either incorporated in the developer are either attached to the surface of said developer by mechanofusion or otherwise, or are present in the developer as a free-flowing micropowder.

4. Dry electrostatographic developer according to claim 1 wherein the inorganic microparticles have been added as a free flowing powder to the developer.

5. Dry electrostatographic developer according to claim 1, wherein the concentration of the inorganic microparticles is comprised between 0.1 and 5% by weight with respect to the toner weight.

6. Dry electrostatographic developer according to claim 1, wherein said inorganic microparticles have a BET specific surface area of at least 100 m2/g.

7. Dry electrostatographic developer according to claim 1, wherein said inorganic microparticles are silica-type microparticles.

8. Dry electrostatographic developer according to claim 7, wherein the silica-type microparticles are surface-modified fumed silica particles treated with a silane compound comprising at least one fluorine atom.

9. Dry electrostatographic developer according to claim 8, wherein said silane compound corresponds to the general formula $$(R^1)_{3-n}\overset{\overset{R_f}{|}}{Si}(OR^2)_n$$

$R^1$ is an alkyl group, preferably a $C_1$–$C_4$ alkyl group,
$R^2$ is a $C_1$–$C_4$ alkyl group e.g. methyl, ethyl,
n is 1, 2 or 3, preferably 3, and
Rf is a fluoroalkyl, fluoroalkoxy or fluoroalkoxyalkyl group comprising at least one fluorine substituent.

10. Dry electrostatographic developer according to claim 1 wherein the acidic binder resin is an addition or condensation polymer having acidic groups selected from the groups consisting of carboxylic acid groups, sulphonic acid groups and phenol-type hydroxy groups.

11. Dry electrostatographic developer according to claim 10 wherein said acidic resin binder is an acidic polyester resin produced by the condensation reaction of a polyol or mixture of polyols with a dicarboxylic acid or mixture of dicarboxylic acids and optionally partly a polyacid having at least 3 carboxylic acid groups yielding some crosslinking.

12. Dry electrostatographic developer according to claim 11 wherein the acidic polyester binder is derived from fumaric acid that is polycondensed with less than 1 equivalent of an ethoxylated and/or propoxylated "bisphenol A".

13. Dry electrostatographic developer according to claim 1 featuring a classified size distribution wherein more than 90 percent by volume of the toner particles have equivalent particle size diameters comprised between 3 and 6 micron.

14. Dry electrostatographic developer according to claim 1 comprising carrier particles apart from the negatively chargeable toner particles.

* * * * *